United States Patent [19]

Murali et al.

[11] Patent Number: 4,684,447

[45] Date of Patent: Aug. 4, 1987

[54] METHOD FOR APPLYING PROTECTIVE COATINGS

[75] Inventors: Jagannathan Murali, Houston, Tex.; Erwin Buck, Ponca City, Okla.

[73] Assignee: Conoco Inc., Ponca City, Okla.

[21] Appl. No.: 842,965

[22] Filed: Mar. 24, 1986

[51] Int. Cl.[4] ..... C23C 28/00

[52] U.S. Cl. ..... 204/38.5; 204/39; 204/58.5

[58] Field of Search ..... 204/38.1, 38.5, 38.7, 204/39, 58.5; 427/34, 423

[56] References Cited

U.S. PATENT DOCUMENTS

| | | | |
|---|---|---|---|
| 2,484,118 | 10/1949 | Reynolds | 204/38.5 X |
| 2,800,707 | 7/1957 | Whitfield et al. | 204/38.5 X |
| 2,917,818 | 12/1959 | Thompson | 204/38.5 X |
| 3,048,497 | 2/1958 | Moller | 117/52 |
| 3,755,090 | 8/1973 | Jackson et al. | 204/34 |
| 3,922,396 | 11/1975 | Speirs et al. | 427/250 |
| 4,061,801 | 12/1977 | Hamada et al. | 427/192 |
| 4,257,854 | 3/1981 | Daenen et al. | 204/36 |
| 4,260,654 | 4/1981 | Baldi | 427/253 |
| 4,619,557 | 10/1986 | Salama et al. | 405/211 |

OTHER PUBLICATIONS

Japan 20913/64, In the abstract.

*Primary Examiner*—John F. Niebling
*Assistant Examiner*—William T. Leader
*Attorney, Agent, or Firm*—Stephen A. Littlefield

[57] ABSTRACT

Flame sprayed aluminum coatings have been shown to be of excellent value in providing cathodic protection to steel structures in a marine environment. The common method of applying flame sprayed aluminum to a steel substrate comprises providing an anchor pattern to the substrate. Such anchor pattern can result in fatigue cracking of the substrate developing within the surface discontinuities of the anchor pattern. The present invention provides a method for providing a layered electroplated aluminum base coating on the substrate to which a flame sprayed aluminum coating may adhere without the need for a roughened surface on the substrate with its consequent potential for reduction of fatigue strength.

6 Claims, No Drawings

METHOD FOR APPLYING PROTECTIVE COATINGS

BACKGROUND OF THE INVENTION

Offshore structures are in constant need of protection from the corrosive environment of sea water. The useful life of offshore steel structures such as oil well drilling and production platforms and piping systems can be severely limited by the corrosive environment of the sea. Conventional protection against such damage adds considerable complication and weight to offshore structures.

Cathodic protection by either sacrificial anodes or impressed current is generally effective in preventing corrosion on fully submerged portions of an offshore structure. In some offshore locations, such as the North Sea, oxygen content is relatively high even in water depths to 1,000 feet. As a consequence, oxidative corrosion is very severe and can readily occur at these depths.

Installation and maintenance of sacrificial anodes adds greatly to the weight and expense of an offshore structure. This is particularly true with respect to a tension leg platform. In a tension leg platform, high-strength, thick walled steel tubulars are constantly maintained in tension between their anchor points on the ocean floor in a floating structure whose buoyancy is constantly in excess of its operating weight. The use of high-strength steel in a tension leg platform for fabricating the mooring and riser elements is necessitated by the desire to reduce the platform displacement and minimize the need for complicated heavyweight tensioning and handling systems. The mooring and riser systems are subjected to more than 100,000,000 floating cycles during a common service life for a tension leg platform. This makes corrosion and, particularly, corrosion fatigue resistance an important design parameter. Therefore, the selection of a corrosion protection system that achieves long term corrosion protection and minimizes the influence of the sea water environment on fatigue resistance is essential to insure the intergrity of the high-strength steel components.

The most common approach to corrosion protection involves the use of aluminum anodes. Such a system has the disadvantage that the cathodic potential on the steel with respect to such aluminum anodes approaches minus 1,050 mV versus a saturated calomel electrode (SCE). This cathodic level can result in hydrogen embrittlement in the high-strength steel used in the structural components,. Testing has shown that a cathodic potential below negative 800 mV (SCE) subjects the high-strength steel to hydrogen embrittlement thereby limiting the crack resistance and fatigue life of the structural elements.

Additionally, a reliable electrical contact must be maintained between a sacrificial anode and the high-strength steel. The electrical attachment method must not impair the mechanical or metallurgical performance of the steel. Mechanical electrical connections are generally not reliable and not recommended for long term use. Brazing and thermite welding can enhance the potential for stress corrosion crackng of highstrength steel. Friction welding of an aluminum stud to a high-strength steel has also been shown to cause failure in test specimens with cracks initiated either under the stud or at the edge of the weld.

An impressed current system often involves throwing current from anodes in relatively remote locations with respect to the structure to be protected. The distance between anodes and remote components can be too great for effective control of the impressed current, particularly at remote locations such as the anchor end of a tension leg mooring system.

For protection of high-strength steel components such as the mooring and riser systems for TLP's, the use of inert coatings cannot be seriously considered without the addition of cathodic protection because of the inevitable damage to and water permeation of the coatings through the life of the platform. Also, some areas of the components have tolerances that do not permit coating. With coatings, the size of the required sacrificial anodes would be greatly reduced by the electrical connection and hydrogen embrittlement problems would be present.

A coating of flame-sprayed aluminum has been proposed for use in marine environments. Such a coating offers the advantage of relatively high bond strength and a uniform potential of about minus 875 mV (SCE). Such flame sprayed aluminum coatings overcome the problems of electrical connection as well as hydrogen embrittlement which are present with aluminum anode cathodic protection systems.

While flame sprayed aluminum coatings appear to solve all of the potential problems with respect to cathodic protection of marine structures, the common method of applying such flame sprayed aluminum coatings can lead to problems affecting the life of the protected structure. Specifically, a flame sprayed aluminum coating generaly requires a roughened "anchor" on the steel substrate to which it is to be applied.

The anchor pattern may be provided by scoring the steel surface or, most commonly, provided by sand or grit blasting to provide a roughened surface. The surface discontinuities induced by these anchor patterning provisions introduce sites which offer increased potential for fatigue cracking during the life of the structural component. The overall fatigue strength of the component can thus be reduced.

The porous nature of a flame sprayed aluminum coating offers additional potential for marine biofouling and, therefore, must be sealed in order to avoid problems associated with biofouling.

SUMMARY OF THE INVENTION

The present invention provides a method whereby a flame sprayed aluminum coating may be effectively bonded to a steel substrate without providing a roughened anchor pattern which can induce fatigue cracking.

In accordance with the invention, a coating process for marine structural components comprises electroplating an adherent aluminum layer to the outer surface of a steel substrate followed by the application of a flame sprayed alumnum coating over the adherent electroplated aluminum layer.

Further in accordance with the invention, the aforementioned electroplated aluminum layer is applied from a molten salt bath having a temperature less than about one half the melting temperature of the steel substrate.

Still further in accordance with the invention, the above-noted electroplated aluminum layer is applied from a nonaqueous plating solution.

Still further in accordance with the invention, the preferred coating process noted above further includes the application of a sealant, antifoulant coating to the outer surface of the porous flame sprayed aluminum coating.

It is therefore an object of this invention to provide a method for applying a protective flame sprayed aluminum coating to marine structures which avoids the potential for inducing fatigue cracking associated with grit blasting or other means for providing an anchor pattern to a substrate.

It is yet another object of the invention to further reduce the potential for hydrogen embrittlement of a steel substrate with the consequent loss of fatigue strength.

It is yet another object of this invention to provide a complete coating system for the cathodic protection of steel marine components which further avoids biofouling common in the marine environment.

DETAILED DESCRIPTION OF THE PREFERRED EMBODIMENT

These and other objects of the invention are accomplished through the manner and form of the present invention to be described in greater detail through a description of a preferred embodiment thereof. It will be understood that such description of the preferred embodiment is for the purposes of illustration only and should not be considered as a limitation upon the scope of the invention.

As used in this specification, the term "flame sprayed aluminum" will be taken to mean aluminum which is applied by entrainment in metallic form in a stream of particles which impinge upon and adhere to the surface to be coated. Thus, both flame spraying and plasma arc spraying shall be considered as being included within the scope of this invention.

In accordance with the invention, a steel structural component is electrocoated with an adherent layer of aluminum prior to the application of a thicker flame sprayed aluminum coating for providing cathodic protection to the steel component. In one preferred embodiment of the invention, the electroplated aluminum coating is applied from a molten salt bath through procedures common in the art. U.S. Pat. No. 3,048,497, is typical of such molten salt electrolytic processes.

In order to avoid affecting the metallurgical properties of a substrate steel, the temperature of the molten salt electrolyte is held below a temperature which will induce crystalline rearrangement in the substrate. Preferably, the temperature of the molten salt electrolyte is held under a temperature which is one half the melting temperature of the steel substrate. Such temperature can readily be determined by those skilled in the art.

In accordance with normal electroplating procedures, the substrate is cleaned by vapor degreasing, detergent cleaning, electrocleaning or other similar processes either alone or in combination.

The electroplated aluminum layer is preferably applied to a thickness of about 1 micron but may be of a thickness within the range of 0.01 microns to 100 microns.

As an alternative to the electrodeposition of aluminum from a molten salt bath, a nonaqueous organic electroplating bath may be used. U.S. Pat. Nos. 4,257,854 and 3,997,410 describe two typical nonaqueous aluminum electroplating baths although it will be understood that any nonaqueous bath common in the art may be utilized.

An advantage of the use of nonaqueous solvent baths and molten salt baths is that no hydrogen is present or evolved which can migrate into the substrate to develop hydrogen embrittlement in the marine structural components. The electrocoating processes provide an adherent aluminum layer which does not affect the mechanical properties of the substrate while providing a base layer to which a flame sprayed aluminum coating can readily adhere.

Following the application of the electroplated aluminum layer, a coating of flame sprayed aluminum is applied to the electrocoated substrate. The thickness of the flame sprayed aluminum coating is dependent upon the desired service life and the environment in which the coated article is to be used. For immersed components having a 20-year service life, a thickness of about 1 to about 25 mils is used. The flame sprayed aluminum particles readily adhere to the electroplated aluminum layer so that a bond strength comparable to the bonding of flame sprayed aluminum to a grit blasted substrate is achieved.

The resultant flame sprayed aluminum coated structural element has an outer surface which is porous in nature and must be sealed. In accordance with another aspect of this invention, an antifoulant coating is applied to the outer surface of the flame sprayed aluminum coating to both seal the coating and provide antifoulant protection. The preferred antifoulant coating comprises a vinyl based sealant coating incorporating flake or powder-form antifoulant materials such as cuprous oxide or tributyl tin oxide. The antifoulant materials dispersed within the vinyl coating dissolve over the life of the coating to provide biocidal action to avoid marine biofouling. Further, the vinyl coating acts as a sealant to eliminate sites at which biofouling materials may attach to the otherwise porous structure of the flame sprayed aluminum coated structural element.

While the invention has been described in the more limited aspects of the preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described our invention, we claim:

1. In a method for applying a flame sprayed aluminum coating to a steel substrate, the improvement which comprises applying an electroplated aluminum layer to said substrate prior to the application of said flame sprayed aluminum coating.

2. The improvement as set forth in claim 1 wherein said step of applying the electroplated aluminum layer comprises electroplating the steel substrate in an aluminum molten salt electroplating bath.

3. The improvement as set forth in claim 1 wherein said step of applying the electroplated aluminum layer comprises electroplating in a nonaqueous organic solvent aluminum electroplating bath.

4. The improvement as set forth in claim 1 wherein said step of applying the electroplated aluminum layer is carried out to apply a thickness of 0.01 to 100 microns of aluminum.

5. The improvement as set forth in claim 1 further including the step of applying an antifoulant sealant coating to the flame sprayed aluminum coating.

6. The improvement as set forth in claim 5 wherein the step of applying an antifouling sealant coating comprises applying a vinyl based sealant containing antifoulant particles selected from the group consisting of cuprous oxide, tributyl tinoxide, and combinations thereof.

* * * * *